US010352586B2

(12) United States Patent
Chaudhry

(10) Patent No.: US 10,352,586 B2
(45) Date of Patent: Jul. 16, 2019

(54) ENCLOSURES FOR WATER HEATERS

(71) Applicant: Rheem Manufacturing Company, Atlanta, GA (US)

(72) Inventor: Raheel A. Chaudhry, Montgomery, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 0 days.

(21) Appl. No.: 15/667,143

(22) Filed: Aug. 2, 2017

(65) Prior Publication Data

US 2019/0041094 A1 Feb. 7, 2019

(51) Int. Cl.

*F24H 9/20* (2006.01)
*F24H 9/02* (2006.01)
*F24H 1/18* (2006.01)

(52) U.S. Cl.

CPC ..... *F24H 9/02* (2013.01); *F24H 1/182* (2013.01); *F24H 1/183* (2013.01); *F24H 9/2007* (2013.01)

(58) Field of Classification Search

CPC ..... F24H 9/02
See application file for complete search history.

(56) References Cited

U.S. PATENT DOCUMENTS 2,600,657 A * 6/1952 Jones ..... A45C 11/24 206/297
3,217,138 A * 11/1965 Drugmand ..... H05B 3/06 219/536
3,356,257 A * 12/1967 Eimer ..... B65D 83/70 220/89.2
4,588,851 A * 5/1986 Turner ..... H02B 1/06 174/138 F
5,163,119 A * 11/1992 Windon ..... F24H 1/182 122/19.2
5,292,464 A * 3/1994 Hanning ..... F24H 1/182 264/276
5,293,844 A * 3/1994 Threatt ..... F24H 1/182 122/19.2
6,349,169 B1 * 2/2002 Jackson ..... B29C 44/1247 392/447
6,898,375 B2 * 5/2005 Henderson ..... F24H 1/182 122/494
7,162,150 B1 1/2007 Welch et al.
7,409,925 B2 * 8/2008 Lannes ..... F24H 1/182 122/19.2
7,600,696 B2 * 10/2009 Hotta ..... F24H 9/2035 122/494
2007/0248143 A1 * 10/2007 Phillips ..... G01K 1/20 374/141
2014/0250670 A1 * 9/2014 Walker ..... F24H 9/124 29/525.02
2016/0363347 A1 * 12/2016 Chaudhry ..... F24H 1/202

* cited by examiner

*Primary Examiner* — Nathaniel Herzfeld
(74) *Attorney, Agent, or Firm* — King & Spalding LLP

(57) ABSTRACT

An enclosure for a water heater can include a cover having at least one body coupling feature and at least one first water heater coupling feature. The enclosure can also include a body detachably coupled to the cover, where the body includes at least one cover coupling feature that couples to the at least one body coupling feature of the cover. The at least one water heater coupling feature can be configured to receive an enclosure coupling feature of the water heater, where the enclosure coupling feature, when received by the at least one water heater coupling feature, secures the body against a tank of the water heater.

20 Claims, 13 Drawing Sheets

ENCLOSURES FOR WATER HEATERS

TECHNICAL FIELD

The present disclosure relates generally to water heaters, and more particularly to an enclosure that couples to a water heater.

BACKGROUND

Water heaters are generally used to provide a supply of hot water. Water heaters can be used in a number of different residential, commercial, and industrial applications. A water heater can supply hot water to a number of different processes. For example, a hot water heater in a residential dwelling can be used for an automatic clothes washer, an automatic dishwasher, one or more showers, and one or more sink faucets. Water heaters use one or more of a number of devices (e.g., valves, heating elements) to control the amount of heated water that can be available for these processes.

SUMMARY

In general, in one aspect, the disclosure relates to an enclosure for a water heater. The enclosure can include a cover having at least one body coupling feature and at least one water heater coupling feature. The enclosure can also include a body detachably coupled to the cover, where the body comprises at least one cover coupling feature that couples to the at least one body coupling feature of the cover, The at least one water heater coupling feature can be configured to receive an enclosure coupling feature of the water heater, where the enclosure coupling feature, when received by the at least one water heater coupling feature, secures the body against a tank of the water heater.

In another aspect, the disclosure can generally relate to a water heater. The water heater can include a tank defined by an inner wall. The water heater can also include an outer wall disposed around the tank, where the outer wall has a first aperture that traverses therethrough. The water heater can further include insulation disposed between the outer wall and the tank, where the insulation has a second aperture that traverses therethrough, where the second aperture is aligned with the first aperture, where the first aperture and the second aperture form a cavity that exposes a portion of the tank. The water heater can also include at least one enclosure coupling feature coupled to the outer wall adjacent to the first aperture. The water heater can further include an enclosure disposed within the cavity, where the enclosure comprises at least one wall, where the at least one wall comprises at least one water heater coupling feature that couples to the at least one enclosure coupling feature. The enclosure can be secured against the tank when the at least one enclosure coupling feature is coupled to the at least one water heater coupling feature.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1A:
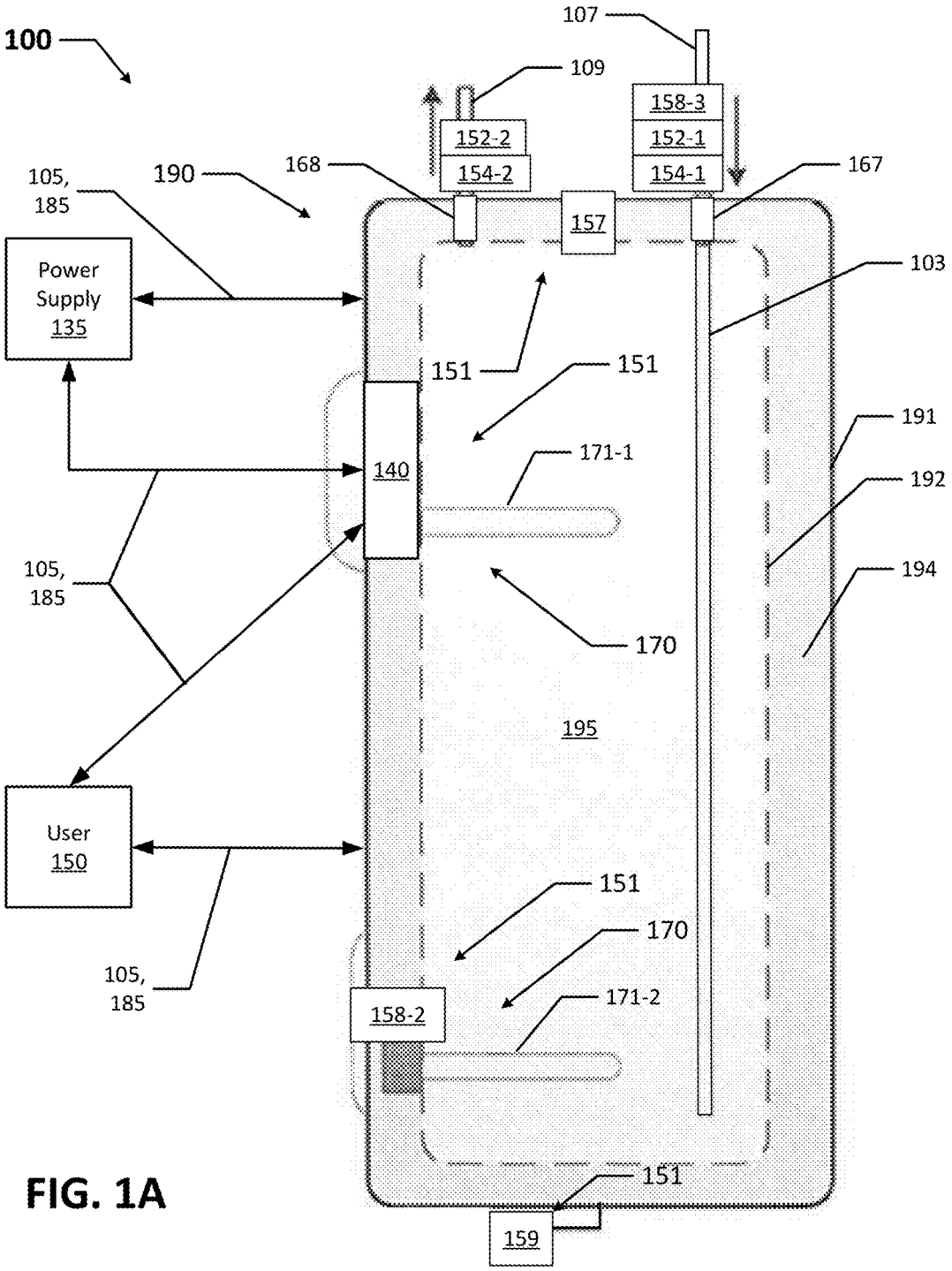
FIGS. 1A and 1B show diagrams of a system that includes a water heater and a controller in accordance with certain example embodiments.

In general, example embodiments provide systems, methods, and devices for enclosures for water heaters. Example embodiments can be used for any size (e.g., capacity) of water heater. Further, example embodiments can be located in any type of environment (e.g., warehouse, attic, garage, storage, mechanical room, basement) for any type (e.g., commercial, residential, industrial) of user. Water heaters used with example embodiments can be used for one or more of any number of processes (e.g., automatic clothes washers, automatic dishwashers, showers, sink faucets, heating systems, humidifiers).

Water heater systems (or components thereof, including example enclosures and associated coupling features) described herein can be made of one or more of a number of suitable materials to allow that device and/or other associated components of a system to meet certain standards and/or regulations while also maintaining durability in light of the one or more conditions under which the devices and/or other associated components of the system can be exposed. Examples of such materials can include, but are not limited to, aluminum, stainless steel, copper, fiberglass, glass, plastic, PVC, ceramic, and rubber.

Components of a water heater system (or portions thereof, including an example enclosure and associated coupling features) described herein can be made from a single piece (as from a mold, injection mold, die cast, or extrusion process). In addition, or in the alternative, components of a water heater system (or portions thereof, including an example enclosure and associated coupling features) can be made from multiple pieces that are mechanically coupled to each other. In such a case, the multiple pieces can be mechanically coupled to each other using one or more of a number of coupling methods, including but not limited to epoxy, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, be wedged into, be in communication with, and/or perform other functions aside from strictly coupling.

A coupling feature (including a complementary coupling feature) as described herein can allow one or more components and/or portions of an example enclosure to become coupled, directly or indirectly, to a portion of a water heater. A coupling feature can include, but is not limited to, a clamp, a portion of a hinge, an aperture, a series of sawtooth-shaped ridges, a recessed area, a protrusion, a slot, a spring clip, a clip, a tab, a detent, and mating threads. One portion of an example enclosure can be coupled to a portion of a water heater by the direct use of one or more coupling features.

In addition, or in the alternative, a portion of an example enclosure can be coupled to a portion of a water heater using one or more independent devices that interact with one or more coupling features disposed on the enclosure. Examples of such devices can include, but are not limited to, a pin, a hinge, a fastening device (e.g., a bolt, a screw, a rivet), a series of sawtooth-shaped ridges, a recessed area, a protrusion, a slot, a clip, a spring clip, a tab, a detent, and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of enclosures for water heaters, one or more of the components shown may be omitted, repeated, and/or substituted. Accordingly, example embodiments of enclosures for water heaters should not be considered limited to the specific arrangements of components shown in any of the figures. For example, features shown in one or more figures or described with respect to one embodiment can be applied to another embodiment associated with a different figure or description.

In addition, if a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. The numbering scheme for the various components in the figures herein is such that each component is a three or four digit number, and corresponding components in other figures have the identical last two digits.

In some cases, example embodiments can be subject to meeting certain standards and/or requirements. Examples of entities that set and/or maintain standards include, but are not limited to, the Department of Energy (DOE), the National Electric Code (NEC), the National Electrical Manufacturers Association (NEMA), the International Electrotechnical Commission (IEC), the American Society of Mechanical Engineers (ASME), the National Fire Protection Association (NFPA), the American Society of Heating, Refrigeration and Air Conditioning Engineers (ASHRAE), Underwriters' Laboratories (UL), and the Institute of Electrical and Electronics Engineers (IEEE). Use of example embodiments described herein meet (and/or allow a corresponding water heater system or portion thereof to meet) such standards when required.

Example embodiments of enclosures for water heaters will be described more fully hereinafter with reference to the accompanying drawings, in which example embodiments of enclosures for water heaters are shown. Enclosures for water heaters may, however, be embodied in many different forms and should not be construed as limited to the example embodiments set forth herein. Rather, these example embodiments are provided so that this disclosure will be thorough and complete, and will fully convey the scope of enclosures for water heaters to those of ordinary skill in the art. Like, but not necessarily the same, elements (also sometimes called components) in the various figures are denoted by like reference numerals for consistency.

Terms such as "first", "second", "third", "left", "right", "top", "bottom", "side", and "within" are used merely to distinguish one component (or part of a component or state of a component) from another. Such terms are not meant to denote a preference or a particular orientation, and are not meant to limit embodiments of enclosures for water heaters. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
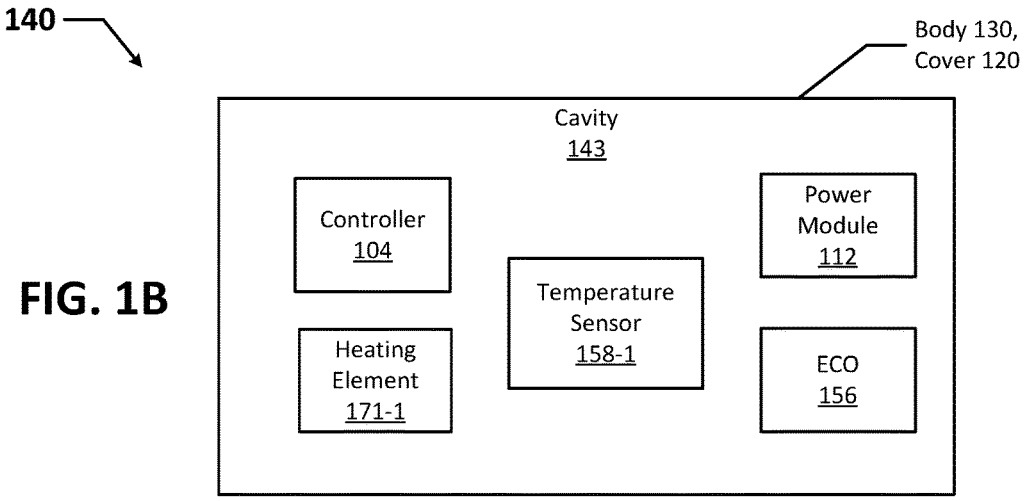

FIGS. 1A and 1B show diagrams of a water heating system 100 that includes a water heater 190 and an example enclosure 140 disposed thereon in accordance with certain example embodiments. Specifically, FIG. 1A shows the water heating system 100, and FIG. 1B shows a system diagram of the enclosure 140. As shown in FIGS. 1A and 1B, the water heating system 100 can include the water heater 190, the enclosure 140, an inlet line 107, an outlet line 109, sensors 151, a power supply 135, and a user 150. The water heater 190 is shown in a cross-sectional side view in FIG. 1A and can include one or more sensor devices 151 (also sometimes called sensor modules or sensors), a dip tube 103, an inlet fitting 167, an outlet fitting 168, a tank 195, and a heating system 170.

As shown in FIG. 1B, the enclosure 140 can include one or more of a number of components. Such components, can include, but are not limited to, a controller 104, a heating element 171-1, a temperature sensor 158-1, a power module 112, and a switch 156 (also called an emergency cutout switch 156 or an ECO 156) that controls the energy (e.g., electrical power, gas) delivered to the heating system 170. When the enclosure 140 includes a controller 104, as in FIG. 1B, such a controller 104 can include one or more of a number of components, including but not limited to a control engine, a communication module, a timer, an energy metering module, a storage repository (which can include, for example, algorithms, protocols, threshold values, and/or stored data), a hardware processor, a memory, a transceiver, an application interface, and, a security module. In certain example embodiments, one or more of the components (e.g., the power module 112) of the enclosure 140 can be part of the controller 104.

The enclosure 140 can include a housing of a cover 120 and a body 130. In such a case, the cover 120 and the body 130 of the enclosure 140 can include at least one wall that forms a cavity 143. In some cases, the enclosure 140 can be designed to comply with any applicable standards so that the enclosure 140 can be located in a particular environment (e.g., a hazardous environment, a high temperature environment, a high humidity environment). An example of the enclosure 140 is described below with respect to FIGS. 3A-5B. The enclosure 140 can be used to house one or more components (e.g., controller 104, ECO 156). In alternative embodiments, any one or more of these or other components can be disposed on the enclosure 140 (e.g., on the cover 120) and/or remotely from the enclosure 140. In some cases, there can be multiple enclosures 140 for a water heater 190.

The components shown in FIGS. 1A and 1B are not exhaustive, and in some embodiments, one or more of the components shown in FIGS. 1A and 1B may not be included in an example system. Further, one or more components shown in FIGS. 1A and 1B can be rearranged. For example, some or all of the inlet line 107 can be part of the water heater 190. Any component of the example water heating system 100 can be discrete or combined with one or more other components of the water heating system 100.

A user 150 may be any person or entity that interacts with the water heater 190 and/or the controller 104. Examples of a user 150 may include, but are not limited to, an engineer, an appliance or process that uses heated water, an electrician, an instrumentation and controls technician, a mechanic, an operator, a consultant, an electric utility, a grid operator, a retail electric provider, an energy marketing company, load forecasting software, a weather forecasting service, a network manager, a labor scheduling system, a contractor, a homeowner, a landlord, a building management company, and a manufacturer's representative. There can be one or multiple users 150.

The user 150 can use a user system (not shown), which may include a display (e.g., a GUI). The user 150 can interact with (e.g., sends data to, receives data from) the controller 104 via the application interface 126 (described below). The user 150 can also interact with the water heater 190 (including any components thereof, including one or more of the sensor devices 151) and/or the power supply 135. Interaction between the user 150, the controller 104, the water heater 190, and the power supply 135 is conducted using signal transfer links 105 and/or power transfer links 185.

Each signal transfer link 105 and each power transfer link 185 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, Zigbee, mobile apps, text/email messages, cellular networking, Bluetooth, WirelessHART, ISA100) technology. For example, a signal transfer link 105 can be (or include) one or more electrical conductors that are coupled to the controller 104 and to a sensor device 151 of the water heater 190. A signal transfer link 105 can transmit signals (e.g., communication signals, control signals, data) between the controller 104, the user 150, the water heater 190 (including components thereof), and/or the power supply 135.

Similarly, a power transfer link 185 can transmit power between the controller 104, the user 150, the water heater 190 (including components thereof), and/or the power supply 135. One or more signal transfer links 105 and/or one or more power transfer links 185 can also transmit signals and power, respectively, between components (e.g., temperature sensor 158-2, flow sensor 154-1) within the water heater 190 and/or within the controller 104.

The power supply 135 provides power, directly or indirectly, to one or more components (e.g., the sensor devices 151, the controller 104, the heating system 170) of the water heating system 100. The power supply 135 can include one or more components (e.g., a transformer, a fuse) that receives power (for example, through an electrical cable) from an independent power source external to the heating system 100 and generates power of a type (e.g., AC, DC) and level (e.g., 240V, 120V) that can be used by one or more components of the heating system 100. For example, the power supply 135 can provide 240V AC power. In addition, or in the alternative, the power supply 135 can be a source of power in itself. For example, the power supply 135 can be or include a battery, a localized photovoltaic power system, or some other source of independent power. In certain example embodiments, the power supply 135 delivers 240V AC.

As stated above, the water heater 190 in this example includes multiple sensor devices 151, a dip tube 103, an inlet fitting 167, an outlet fitting 168, a tank 195, and a heating system 170. The water heater 190 has an outer wall 191 and an inner wall 192, where the inner wall 192 forms the tank 195. Insulation 194 can be disposed between the outer wall 191 and the inner wall 192 to help the tank 195 to retain heat longer. The inlet fitting 167 can be disposed within the insulation 194 and couple to the inlet line 107 at its top end and to the dip tube 103 at its bottom end. The outlet fitting 168 can also be disposed within the insulation 194 and couple to the outlet line 109 at its top end. In this example, both the inlet fitting 167 and the outlet fitting 168 are disposed at the top end of the water heater 190.

The inlet line 107 can be a pipe or other vessel that delivers unheated water to the tank 195 of the water heater 190. The distal end of the inlet line 107 is coupled, directly or indirectly, to the top end of the inlet fitting 167. The bottom end of the inlet fitting is coupled to the proximal end of the dip tube 103, which is disposed entirely within the water heater 190. The dip tube 103 can allow for the flow of unheated water into the tank 195 of the water heater 190. The dip tube 103 has a distal end that can be disposed at any point within the tank 195. Typically, as in this case, the distal end of the dip tube 103 is disposed near the bottom end of the tank 195. The top end of the outer wall 191 and the inner wall 192 of the water heater 190 have an aperture in which the inlet fitting 167 can be disposed therein. This configuration allows unheated water to flow from an external source into the tank 195 of the water heater 190.

Similarly, the outlet line 109 can be a pipe or other vessel that can allow for the heated water in the tank 195 to flow out of the water heater 190. The outlet line 109 has a distal end that can be disposed at any point within the tank 195. Typically, as in this case, the distal end of the outlet line 109 is disposed near the top end of the tank 195. The top end of the outer wall 191 and the inner wall 192 of the water heater 190 have an aperture in which the outlet fitting 168 can be disposed. A segment of the outlet line 109 can be coupled to the bottom end of the outlet fitting 168, allowing that segment of the outlet line 109 to extend into the tank 195. The remainder of the outlet line 109 is coupled to the top end of the outlet fitting 168. This configuration allows heated water in the tank 195 to be drawn from the tank 195 of the water heater 190 so that the heated water can be delivered to one or more of a number of devices (e.g., clothes washer, dishwasher, faucets, shower heads) that use the heated water.

Each of the sensor devices 151 can measure one or more of a number of parameters. Examples of types of sensors 151 can include, but are not limited to, temperature sensor, a pressure sensor, a flow rate sensor, a scale, a voltmeter, an ammeter, a power meter, an ohmmeter, an electric power meter, and a resistance temperature detector. A sensor 151 can also include one or more components and/or devices (e.g., a potential transformer, a current transformer, electrical wiring) related to the measurement of a parameter.

A parameter that can be measured by a sensor 151 can include, but is not limited to, pressure, flow rate, current, voltage, power, resistance, weight, and temperature. In certain example embodiments, the parameter or parameters measured by a sensor 151 can be used by the controller 104 to determine an amount of heated water that is currently available within the tank 195 of the water heater 190 and/or how long it will take for an amount of heated water within the tank 195 of the water heater 190 to become available. Each sensor 151 can use one or more of a number of communication protocols. A sensor 151 can be a stand-alone device or integrated with another component (e.g., the heating system 170) in the system 100. A sensor 151 can measure a parameter continuously, periodically, based on the occurrence of an event, based on a command received from the control module 106 of the controller 104, and/or based on some other factor.

In this example, there are three temperature sensors 158, at least one flow sensor 154, and a water leak sensor 159. The water leak sensor 159 is disposed toward the bottom end of the water heater 190 and detects a leak in the tank 195 of the water heater 190. The flow sensor 154 measures the rate of flow of unheated water in the inlet line 107 when entering the tank 195. Temperature sensor 158-1 is located toward the top end (e.g., approximately ¼ the height of the tank 195 from the top end of the tank 195) and measures the temperature of the water (e.g., heated water, unheated water, mixture of heated water and unheated water) in the tank 195 at that point.

This temperature measured by temperature sensor 158-1 can be an indication of the maximum temperature of the heated water in the tank 195, although, since heat rises, the temperature of the heated water in the tank 195 above the temperature sensor 158-1 is same or higher than the temperature measured by the temperature sensor 158-1. In certain example embodiments, the temperature sensor 158-1 is surface mounted, meaning that the temperature sensor 158-1 is mounted to the inner wall 192 of the water heater 190 that forms the tank 195. In such a case, the temperature sensor 158-1 must be secured against the inner wall 192 in order to operate properly. As shown below with respect to FIG. 3D, when the temperature sensor 158-1 is mounted within the example enclosure 140, one or more coupling features (e.g., coupling features 321 described below) of the enclosure 140 can be used to secure the enclosure 140 (and so also the temperature sensor 158-1) against the inner wall 192.

Temperature sensor 158-2 is located toward the bottom end (e.g., approximately ¼ the height of the tank 195 from the bottom end of the tank 195) and measures the temperature of the water (e.g., heated water, unheated water, mixture of heated water and unheated water) in the tank 195 at that point. Since heat rises, the temperature measured by temperature sensor 158-2 can be no greater than the temperature measured by the temperature sensor 158-1. If this event occurs, the controller 104 can determine that temperature sensor 158-1 and/or temperature sensor 158-2 are faulty and require maintenance and/or replacement. Temperature sensor 158-3 measures the temperature of the unheated water in the inlet line 107 before the unheated water flows into the tank 195. The controller 104 uses the measurements made by some or all of these sensors 151 to determine such things as the amount of heated water available in the tank 195 for immediate use and how long it will take for a certain amount of heated water to become available in the tank 195.

As with temperature sensor 158-1, temperature sensor 158-2 and/or temperature sensor 158-3 can be surface mounted relative to the tank 195. In such a case, temperature sensor 158-2 and/or temperature sensor 158-3 can be secured against the inner wall 192 in order to operate properly. In such a case, temperature sensor 158-2 and/or temperature sensor 158-3 can be mounted within an example enclosure 140, where one or more coupling features (e.g., coupling features 321 described below) of the enclosure 140 can be used to secure the enclosure 140 (and so also the temperature sensor 158-2 and/or temperature sensor 158-3) against the inner wall 192.

The water heater 190 can also include one or more valves 152. In this example, the water heater 190 includes a valve 152-1 that controls the rate of flow (or the flow itself) of the unheated water in the inlet tube 107, as well as an optional valve 152-2 that controls the rate of flow (or the flow itself) of heater water in the outlet tube 109. In certain example embodiments, the position (e.g., fully open, fully closed, 30% open) of a valve 152 can be controlled by the controller 104. The ECO 156 controls the energy (e.g., electrical power, gas) delivered to the heating system 170. The ECO 156 can have an open position (preventing energy from flowing to the heating system 170) and a closed position (allowing energy to flow to the heating system 170). The position and operation of the ECO 156 is independent of the controller 104.

As with temperature sensor 158-1, the ECO 156 can be surface mounted relative to the tank 195. In such a case, the ECO 156 can be secured against the inner wall 192 in order to operate properly. In such a case, the ECO 156 can be mounted within an example enclosure 140, where one or more coupling features (e.g., coupling features 321 described below) of the enclosure 140 can be used to secure the enclosure 140 (and so also the ECO 156) against the inner wall 192.

The water heater 190 can also include a temperature and pressure relief valve 157 that is disposed in the top of the tank 195, the top of the outer wall 191, and the insulation disposed therebetween. The relief valve 157 can be a purely mechanical device (e.g., not controlled by the controller 104) that detects when the pressure and/or temperature within the tank 195 exceeds a threshold value for that parameter. If such an event were to occur, the relief valve 157 would operate from a normally-closed position to an open position.

If the relief valve 157 determines that the pressure within the tank 195 exceeds a maximum threshold value, then the relief valve 157 opens to allow the excess pressure to vent out the top of the water heater 190 into the ambient environment. When the pressure within the tank 195 measured by the relief valve 157 falls back within a safe range (another threshold value), then the relief valve 157 returns to the closed position. Similarly, if the relief valve 157 determines that the temperature within the tank 195 exceeds a maximum threshold value, then the relief valve 157 opens to allow the excess temperature to vent out the top of the water heater 190 into the ambient environment. When the temperature within the tank 195 measured by the relief valve 157 falls back within a safe range (another threshold value), then the relief valve 157 returns to the closed position.

The heating system 170 of the water heater 190 can include one or more devices (or components thereof) that consume energy (e.g., electricity, natural gas, propane) during operation. An example of such a device or component of the heating system 170 can include the heating elements 171 shown in FIG. 1A. In this case, there are two heating elements 171 that extend toward the center of the tank 195. Heating element 171-1 is located toward the top of the tank 195, approximately ⅓ the height of the tank 195 from the top end of the tank 195. Heating element 171-2 is located toward the bottom of the tank 195, approximately ⅙ the height of the tank 195 from the bottom end of the tank 195.

Those of ordinary skill in the art will appreciate that heating systems 170 for water heaters 190 can have any of a number of other configurations. In any case, the controller 104 is aware of the devices, components, ratings, positioning, and any other relevant information regarding the heating system 170 relative to the tank 195. In some cases, one or more devices of the heating system 170 can have its own local controller. In such a case, the controller 104 can communicate with the local controller of the heating system 170 using signal transfer links 105 and/or power transfer links 185.

The user 150, the power supply 135, and/or the water heater 190 (including the sensors 151 and a local controller, if any) can interact with the controller 104 in accordance with one or more example embodiments. Specifically, the controller 104 receives data (e.g., information, communications, instructions, updates to firmware) from and sends data (e.g., information, communications, instructions) to the user 150, the power supply 135, and/or the water heater 190. The user 150, the power supply 135, and the water heater 190 (including portions thereof) can include an interface to receive data from and send data to the controller 104 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof. For example, referring to FIG. 2 below, the controller 104 can include a user interface having one or more of a number of I/O devices 216 (e.g., buzzer, alarm, indicating light, pushbutton).

The controller 104, the user 150, the power supply 135, and/or the water heater 190 can use their own system or share a system in certain example embodiments. Such a system can be, or contain a form of, an Internet-based or an intranet-based computer system that is capable of communicating with various software. A computer system includes any type of computing device and/or communication device, including but not limited to the controller 104. Examples of such a system can include, but are not limited to, a desktop computer with a Local Area Network (LAN), a Wide Area Network (WAN), Internet or intranet access, a laptop computer with LAN, WAN, Internet or intranet access, a smart phone, a server, a server farm, an android device (or equivalent), a tablet, smartphones, and a personal digital assistant (PDA). Such a system can correspond to a computer system as described below with regard to FIG. 2.

Further, as discussed above, such a system can have corresponding software (e.g., user software, sensor device software). The software can execute on the same or a separate device (e.g., a server, mainframe, desktop personal computer (PC), laptop, PDA, television, cable box, satellite box, kiosk, telephone, mobile phone, or other computing devices) and can be coupled by the communication network (e.g., Internet, Intranet, Extranet, LAN, WAN, or other network communication methods) and/or communication channels, with wire and/or wireless segments according to some example embodiments. The software of one system can be a part of, or operate separately but in conjunction with, the software of another system within the water heating system 100.

The controller 104 can be a stand-alone device or integrated with another component (e.g., the water heater 190) in the water heating system 100. When the controller 104 is a stand-alone device, the controller 104 can include a housing. In such a case, the housing can include at least one wall that forms a cavity. In some cases, the housing can be designed to comply with any applicable standards so that the controller 104 can be located in a particular environment (e.g., a hazardous environment, a high temperature environment, a high humidity environment).

The housing of the controller 104 can be used to house one or more components of the controller 104. For example, the controller 104 can include a control engine, a communication module, a timer, an energy metering module, a storage repository, a hardware processor, memory, a transceiver, an application interface, and a security module, some or all of which can be disposed in a cavity formed by a housing. In alternative embodiments, any one or more of these or other components of the controller 104 can be disposed on a housing and/or remotely from a housing.

The controller 104 can perform any of a number of functions that operate the water heater 190 or portions thereof (e.g., the heating system 170) over time and/or at a particular point in time. The controller 104 can provide power, control, communication, and/or other similar signals to the user 150, the power supply 135, and the water heater 190 (including components thereof). Similarly, the controller 104 can receive power, control, communication, and/or other similar signals from the user 150, the power supply 135, and the water heater 190. The controller 104 can control a portion of the water heater 190 automatically and/or based on power, control, communication, and/or other similar signals received from another device through a signal transfer link 105 and/or a power transfer link 185.

The controller 104 may include a printed circuit board, upon which the hardware processor 120 and/or one or more discrete components of the controller 104 are positioned. In certain example embodiments, the controller 104 does not include a hardware processor 120. In some cases, the controller 104 can include, as an example, one or more field programmable gate arrays (FPGA), one or more insulated-gate bipolar transistors (IGBTs), and one or more integrated circuits (ICs). Using FPGAs, IGBTs, ICs, and/or other similar devices known in the art allows the controller 104 (or portions thereof) to be programmable and function according to certain logic rules and thresholds without the use of a hardware processor. Alternatively, FPGAs, IGBTs, ICs, and/or similar devices can be used in conjunction with one or more hardware processors.

The power module 112 provides power to one or more other components (e.g., timer 110, control engine 106) of the controller 104. In addition, in certain example embodiments, the power module 112 can provide power to one or more components (e.g., the heating system 170 of the water heater 190, the ECO 156, a valve 152) of the water heating system 100. The power module 112 can include one or more of a number of single or multiple discrete components (e.g., transistor, diode, resistor), and/or a microprocessor. The power module 112 may include a printed circuit board, upon which the microprocessor and/or one or more discrete components are positioned. In some cases, the power module 112 can include one or more components that allow the power module 112 to measure one or more elements of power (e.g., voltage, current) that is delivered to and/or sent from the power module 112.

The power module 112 can include one or more components (e.g., a transformer, a diode bridge, an inverter, a converter) that receives power (for example, through an electrical cable) from the power supply 135 and generates power of a type (e.g., AC, DC) and level (e.g., 12V, 24V, 120V) that can be used by the other components of the controller 104 and/or by the water heater 190. For example, 240V AC received from the power supply 135 by the power module 112 can be converted to 12V DC by the power module 112. The power module 112 can use a closed control loop to maintain a preconfigured voltage or current with a tight tolerance at the output. The power module 112 can also protect the remainder of the electronics (e.g., hardware processor, transceiver) in the controller 104 from surges generated in the line.

In addition, or in the alternative, the power module 112 can be a source of power in itself to provide signals to components of the controller 104 and/or other portions of the water heater 190. For example, the power module 112 can include a battery. As another example, the power module 112 can include a localized photovoltaic power system. In such a case, the controller 104 can direct the power generated by the power module 112. In this way, power can be conserved when it is not needed at a particular point in time.

Figure 2:
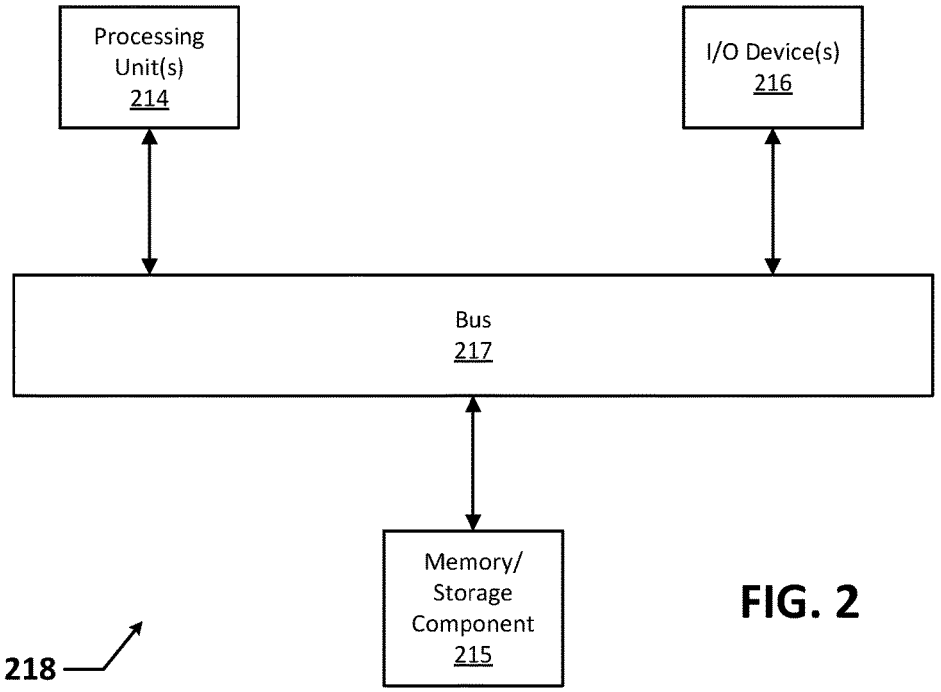
FIG. 2 shows a computing device in accordance with certain example embodiments.

FIG. 2 illustrates one embodiment of a computing device 218 that implements one or more of the various techniques described herein, and which is representative, in whole or in part, of the elements described herein pursuant to certain example embodiments. Computing device 218 is one example of a computing device and is not intended to suggest any limitation as to scope of use or functionality of the computing device and/or its possible architectures. Neither should computing device 218 be interpreted as having any dependency or requirement relating to any one or combination of components illustrated in the example computing device 218.

Computing device 218 includes one or more processors or processing units 214, one or more memory/storage components 215, one or more input/output (I/O) devices 216, and a bus 217 that allows the various components and devices to communicate with one another. Bus 217 represents one or more of any of several types of bus structures, including a memory bus or memory controller, a peripheral bus, an accelerated graphics port, and a processor or local bus using any of a variety of bus architectures. Bus 217 includes wired and/or wireless buses.

Memory/storage component 215 represents one or more computer storage media. Memory/storage component 215 includes volatile media (such as random access memory (RAM)) and/or nonvolatile media (such as read only memory (ROM), flash memory, optical disks, magnetic disks, and so forth). Memory/storage component 215 includes fixed media (e.g., RAM, ROM, a fixed hard drive, etc.) as well as removable media (e.g., a flash memory drive, a removable hard drive, an optical disk, and so forth).

One or more I/O devices 216 allow a customer, utility, or other user to enter commands and information to computing device 218, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 218 is connected to a network (not shown) (e.g., a local area network (LAN), a wide area network (WAN) such as the Internet, cloud, or any other similar type of network) via a network interface connection (not shown) according to some example embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other example embodiments. Generally speaking, the computer system 218 includes at least the minimal processing, input, and/or output means necessary to practice one or more embodiments.

Further, those skilled in the art will appreciate that one or more elements of the aforementioned computer device 218 can be located at a remote location and connected to the other elements over a network in certain example embodiments. Further, one or more embodiments is implemented on a distributed system having one or more nodes, where each portion of the implementation (e.g., controller 104) is located on a different node within the distributed system. In one or more embodiments, the node corresponds to a computer system. Alternatively, the node corresponds to a processor with associated physical memory in some example embodiments. The node alternatively corresponds to a processor with shared memory and/or resources in some example embodiments.

Figure 3B:
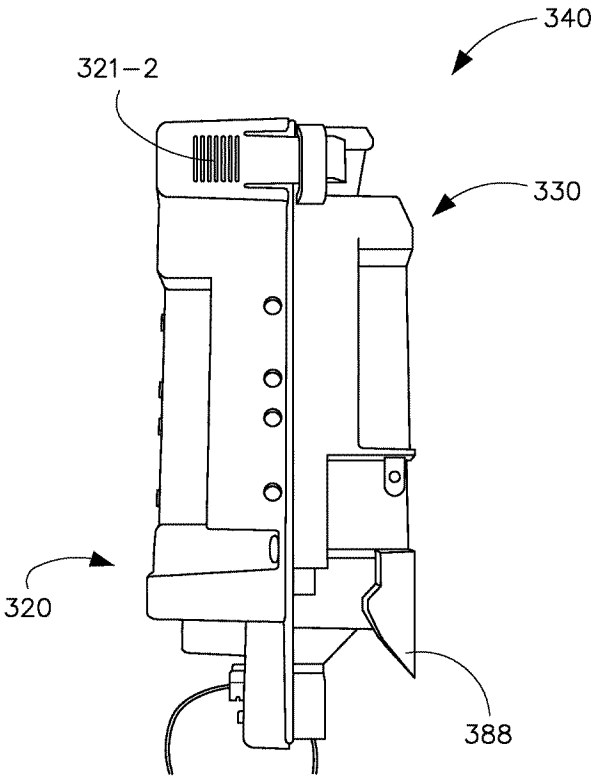
FIGS. 3A-3F show various views of an enclosure for water heaters in accordance with certain example embodiments.
Figure 3A:
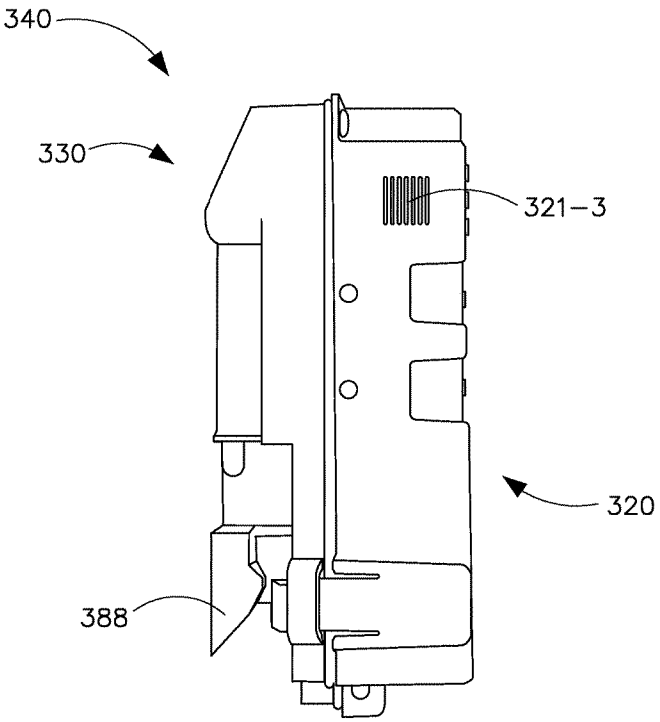
Figure 3D:
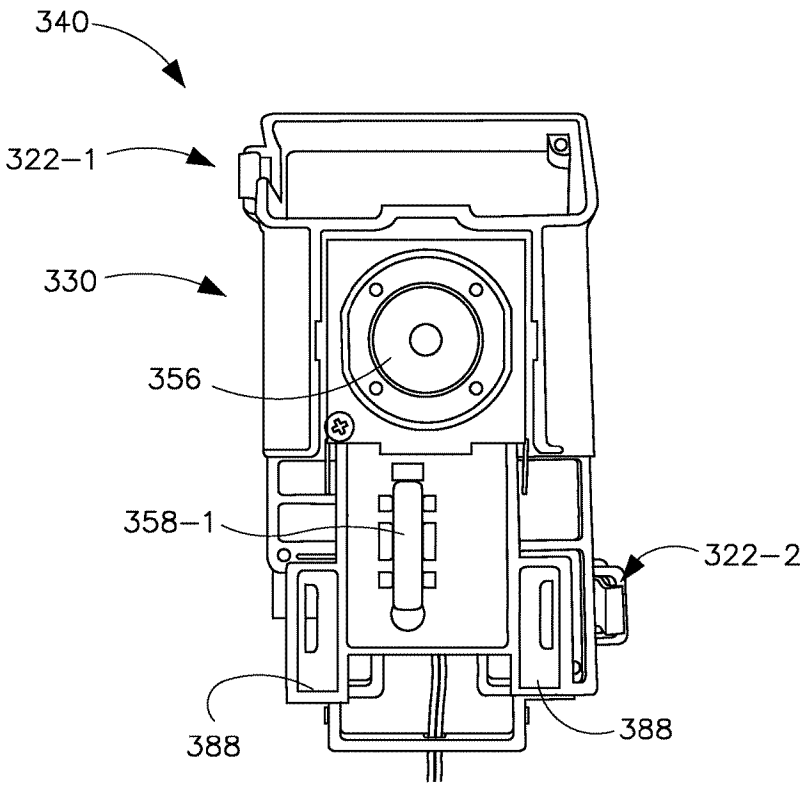
Figure 3C:
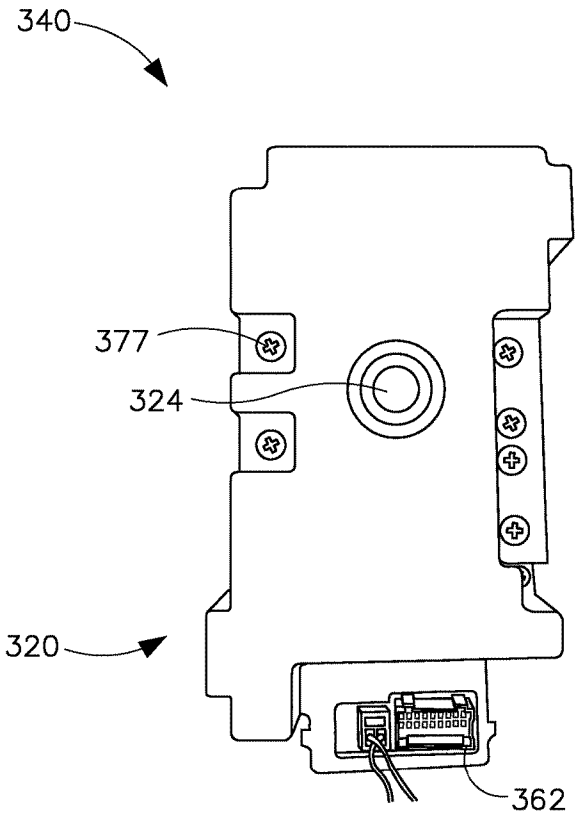
Figure 3E:
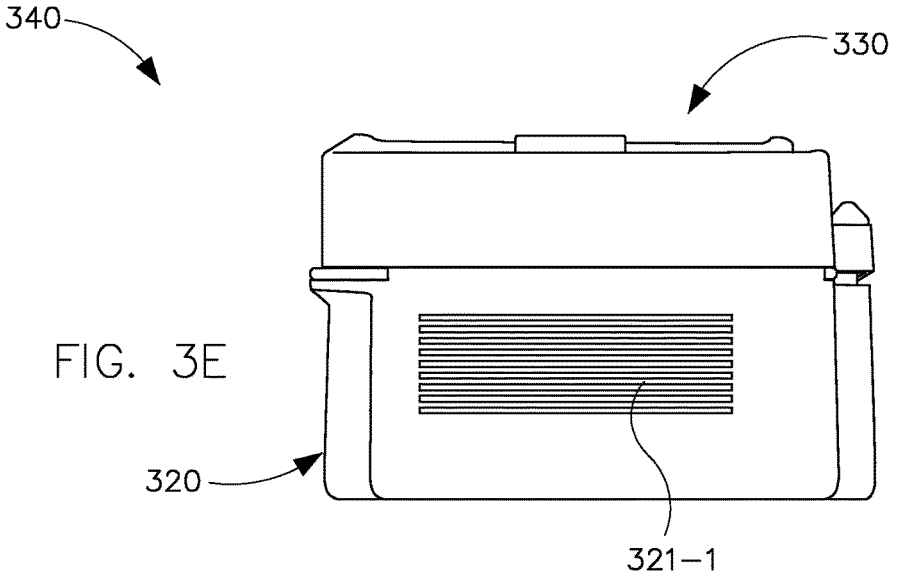
Figure 3F:
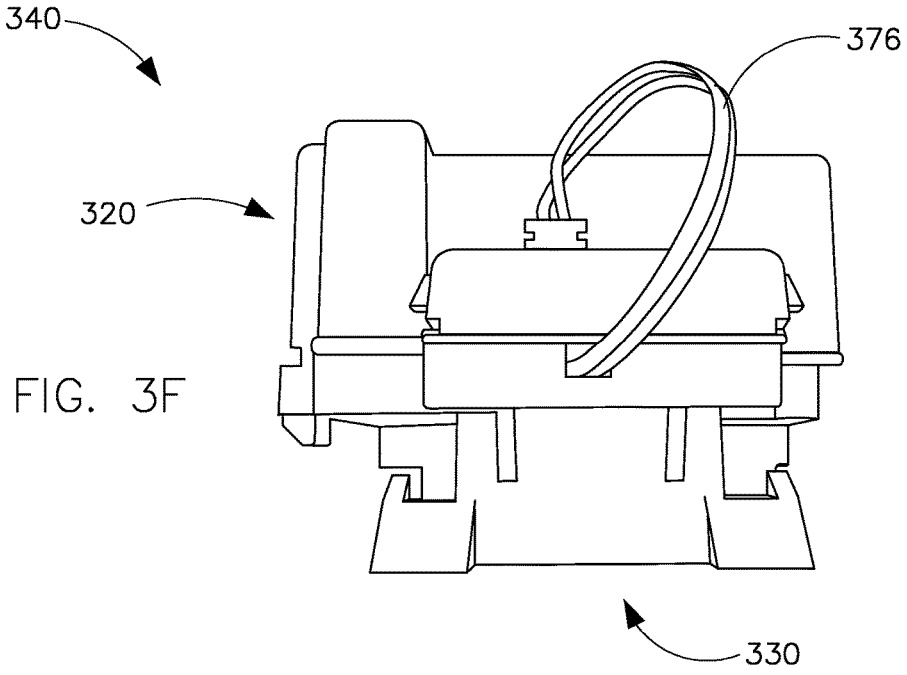

FIGS. 3A-3F show various views of an enclosure 340 for water heaters in accordance with certain example embodiments. Specifically, FIG. 3A shows a left side view of the enclosure 340. FIG. 3B shows a right side view of the enclosure 340. FIG. 3C shows a front view of the enclosure 340. FIG. 3D shows a rear view of the enclosure 340. FIG. 3E shows a top view of the enclosure 340. FIG. 3F shows a bottom view of the enclosure 340.

Figure 4B:
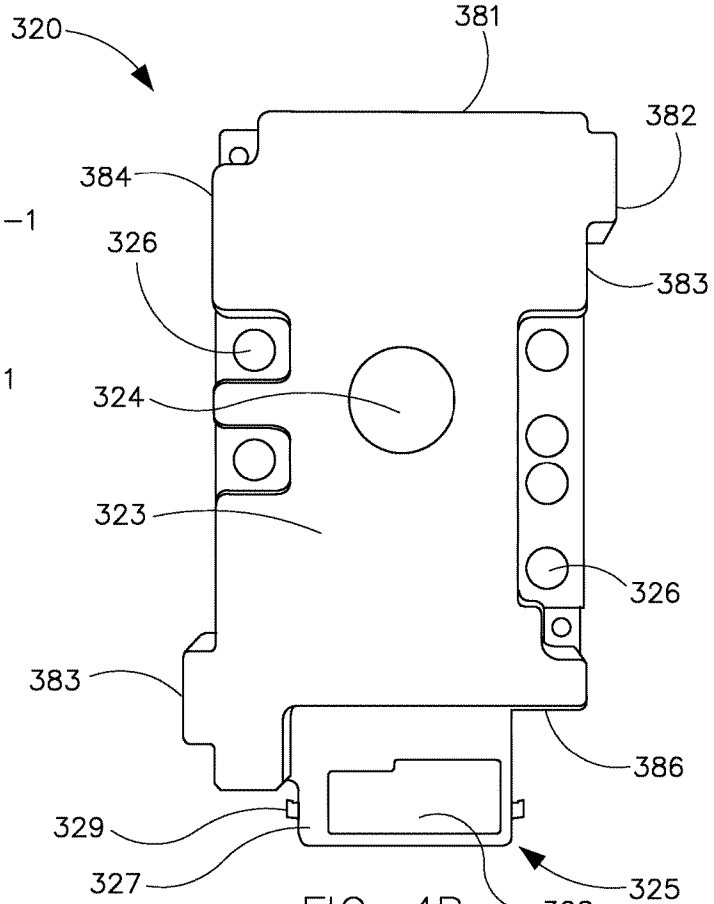
FIGS. 4A-4F show various views of a cover of the enclosure of FIGS. 3A-3F.
Figure 4A:
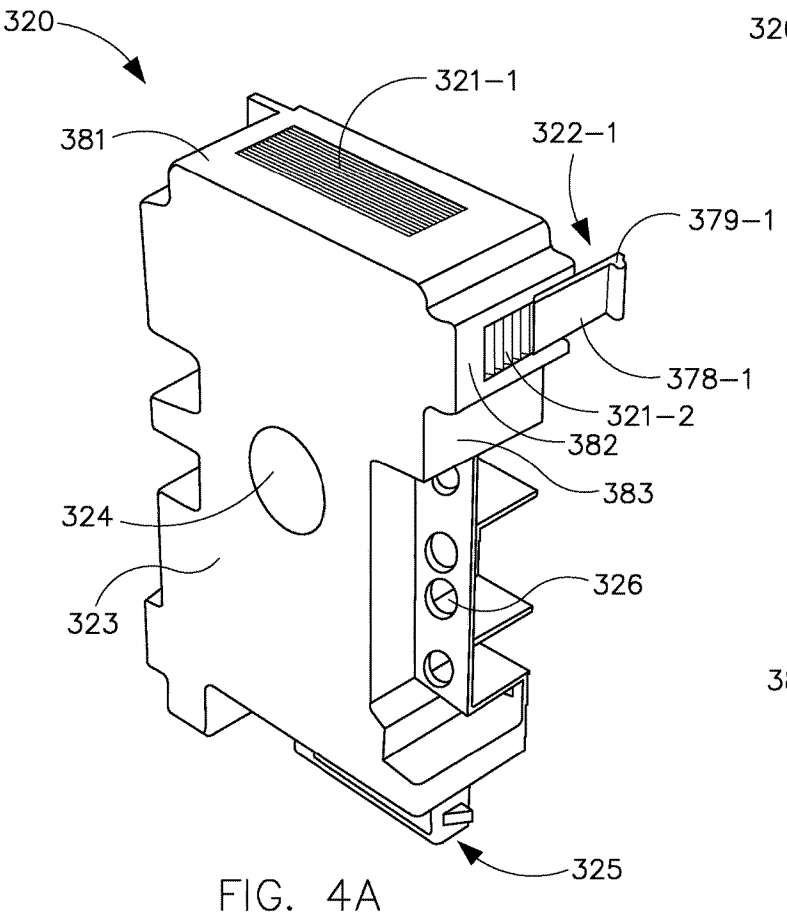
Figure 4D:
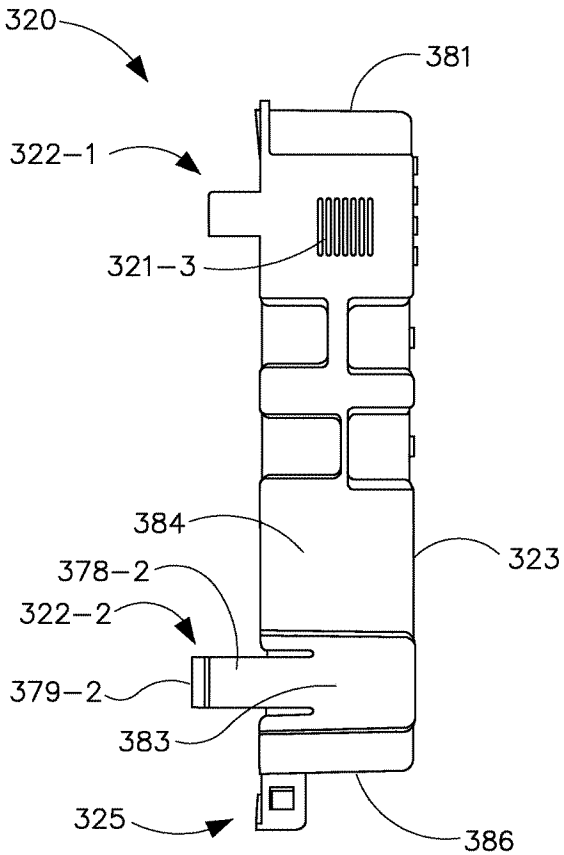
Figure 4C:
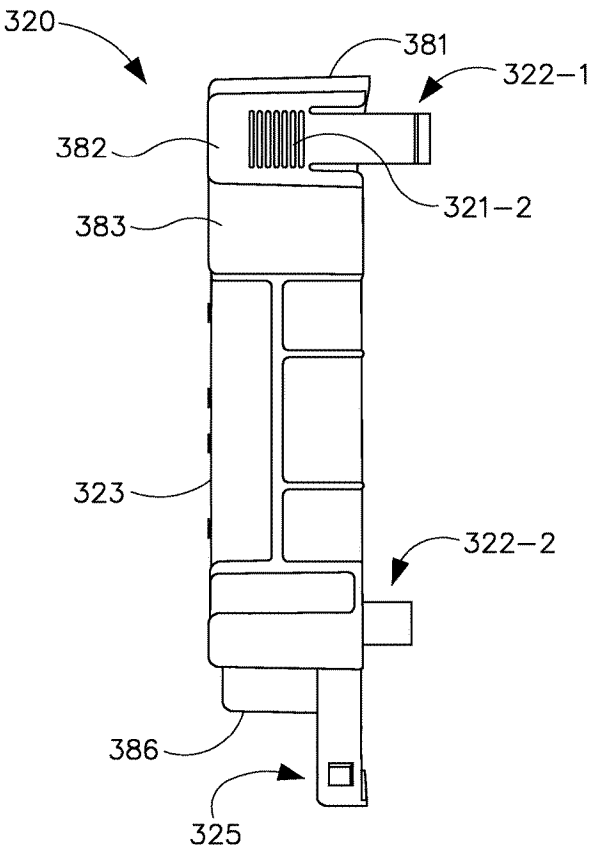
Figure 4E:
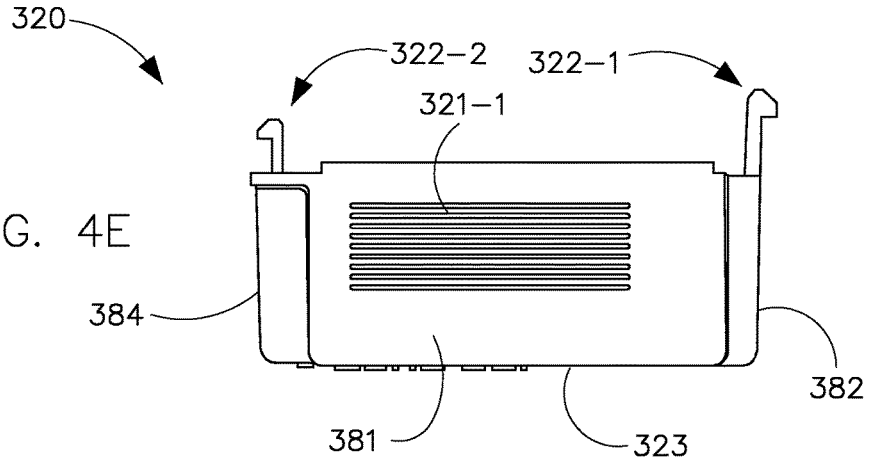
Figure 4F:
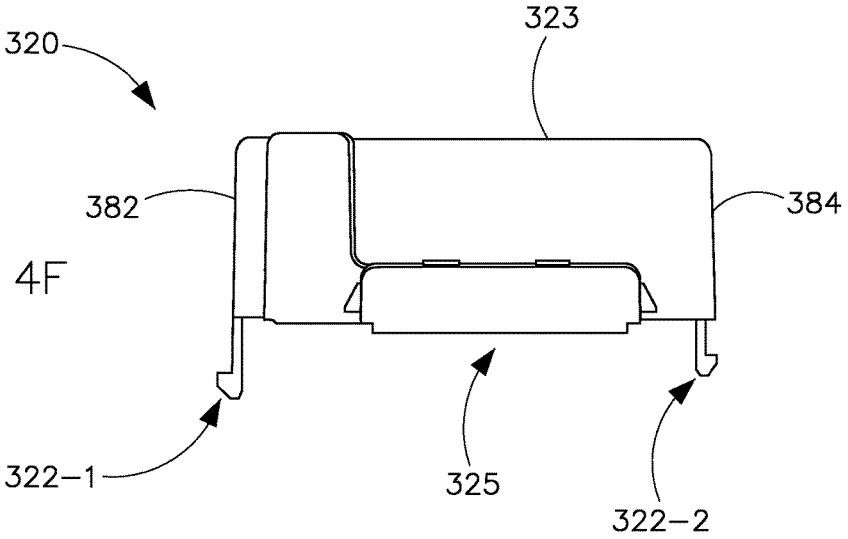
Figure 5B:
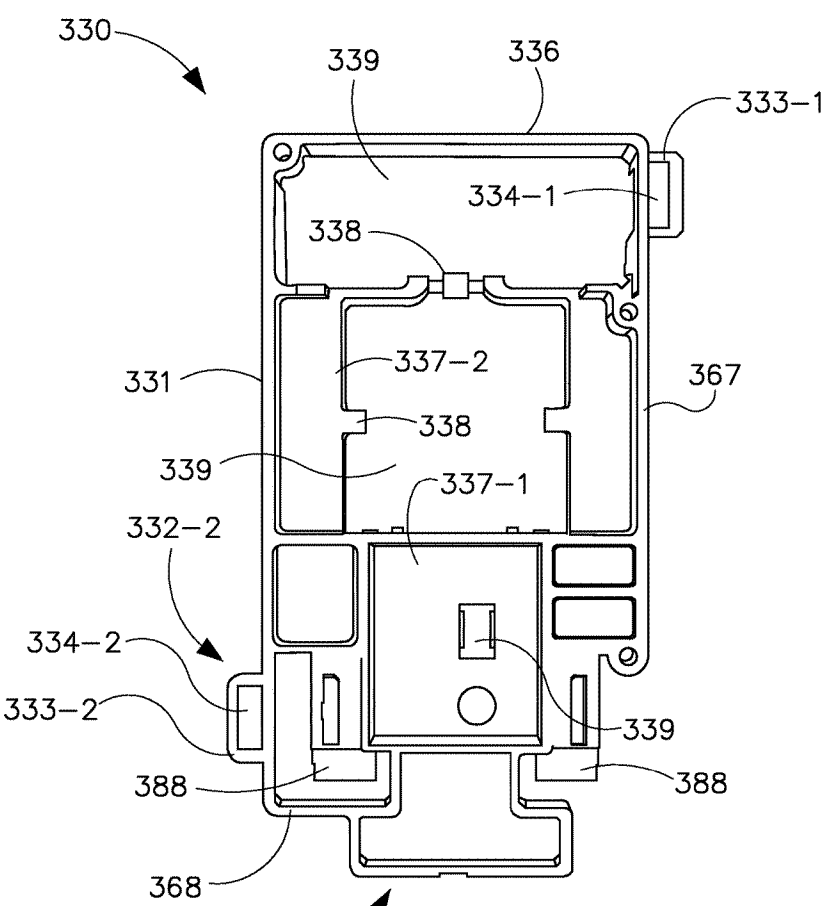
FIGS. 5A and 5B show various views of a body of the enclosure of FIGS. 3A-3F.
Figure 5A:
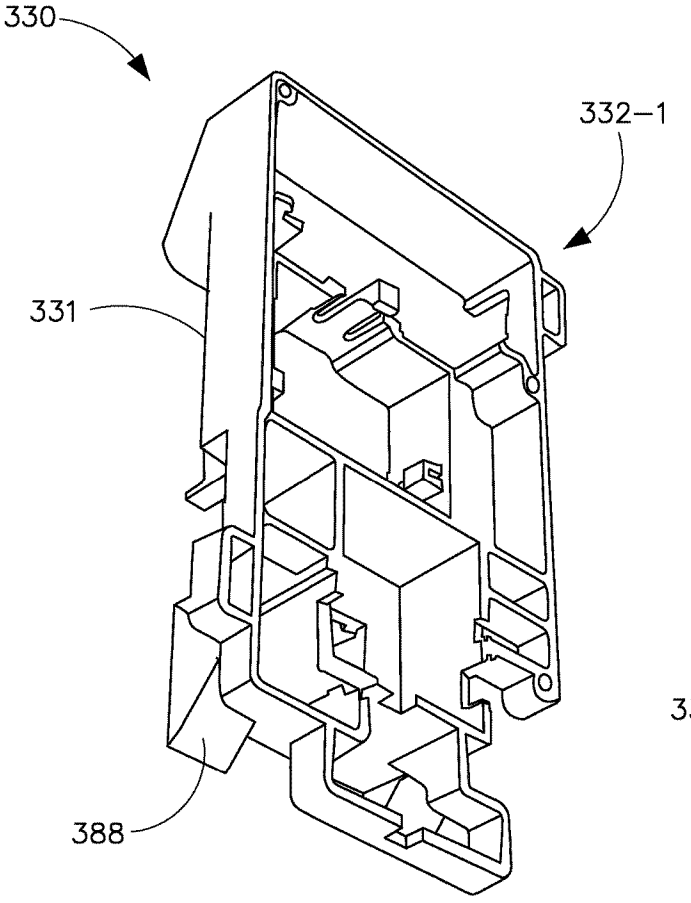

FIGS. 4A-4F show various views of a cover 320 of the enclosure of FIGS. 3A-3F. Specifically, FIG. 4A shows a top-side perspective view of the cover 320 of the enclosure 330 of FIGS. 3A-3F. FIG. 4B shows a front view of the cover 320. FIG. 4C shows a right side view of the cover 320. FIG. 4D shows a left side view of the cover 320. FIG. 4E shows a top view of the cover 320. FIG. 4F shows a bottom view of the cover 320. FIGS. 5A shows a bottom-side perspective view of the body 330 of the enclosure 340 of FIGS. 3A-3F. FIG. 5B shows a front view of the body 330.

Referring to FIGS. 1A-5B, the cover 320 has at least one wall. For example, in this case, the cover 320 has a front wall 323, a left side wall 384, a right side wall 383, a top wall 381, and a bottom wall 386. The example cover 320 can include one or more of a number of features. As an example, in this case, the cover 320 includes at least one coupling feature 322 (also called a body coupling feature 322 herein) that is used to couple the cover 320 to the body 330 of the enclosure 340. In this case, the cover 320 includes two coupling features 322 in the form of tabs 379 disposed at an end of an extension 378.

Coupling feature 322-1 is integrated with a protrusion 382 of the right side wall 383 and extends away from front wall 323. The protrusion 382 is located toward the top of the right side wall 383. The tab 379-1 of the coupling feature 322-1 extends outward at an acute angle relative to the extension 378-1 at the distal end of the extension, where the height of the tab 379-1 decreases closer to the distal end of the extension 378-1. Coupling feature 322-2 is integrated with a protrusion 383 of the left side wall 384 and extends away from front wall 323. The protrusion 383 is located toward the bottom of the left side wall 384. The tab 379-2 of the coupling feature 322-2 extends outward at an acute angle relative to the extension 378-2 at the distal end of the extension 378-2, where the height of the tab 379-2 decreases closer to the distal end of the extension 378-2.

As another example of features of the cover 320, as shown in FIGS. 3A-4F, can be a number of coupling features 326 to coupling one or more electrical conductors to one or more components (e.g., a circuit board, a relay, a control mechanism for a heating element 171-1, the controller 104) disposed within the enclosure 340. In this case, the coupling features 326 are apertures that receive electrical conductors 376 and/or fastening devices 377 (e.g., screws).

As yet another example of features of the cover 320, as shown in FIGS. 3A-4F, can be an extension 325. In this case, the extension 325 is located at the bottom end of the cover 320. The extension 325 can include an extension body 327 that forms an aperture 328 that traverses therethrough to allow access to one or more electrical connector ends 362. The extension 325 can also include one or more of a number of coupling features 329 (in this case, tabs) that are used to couple to the body 330 of the enclosure 340.

As still another example of features of the cover 320, as shown in FIGS. 3A-4F, can be an aperture 324 that traverses therethrough to allow access to a component (e.g., the ECO 356, a display) disposed within the enclosure 340 without removing or otherwise decoupling the cover 320 from the body 330 of the enclosure 340. While one such aperture 324 is shown in this example, there can be multiple apertures 324 disposed in the cover 320.

As still another example of features of the cover 320, as shown in FIGS. 3A-4F, can be one or more coupling features 321 (also called water heater coupling features 321). Such coupling features 321 can be coupled (e.g., fixedly, detachably), directly or indirectly, to a coupling feature (described below in FIGS. 6C-8) of the water heater 190. The coupling features 321, when coupled to complementary coupling features of the water heater 190, secure the enclosure 340 against the inner wall 192 of the water heater 190. In addition, or in the alternative, the coupling features 321 can be disposed on the outer surface of one or more walls of the body 330.

In this case, the coupling features 321 are a series of parallel ridges disposed on the outer surface of the cover 320, and there are three such coupling features 321. Coupling feature 321-1 is disposed on the top wall 381 of the cover 320. Coupling feature 321-2 is disposed on the protrusion 382 of the right side wall 383 of the cover 320, adjacent to coupling feature 322-1. Coupling feature 321-3 is disposed on the right side wall 381 of the cover 320, adjacent to the top wall 381.

The body 330 of the enclosure 340 has at least one wall. For example, in this case, the body 330 has a rear wall 337, a left side wall 331, a right side wall 367, a top wall 336, and a bottom wall 368. The example body 330 can include one or more of a number of features. As an example, in this case, the body 330 includes at least one coupling feature 332 (also called a cover coupling feature 332 herein) that is used to couple the cover 320 to the body 330 of the enclosure 340. In this case, the body 330 includes two coupling features 332 in the form of an aperture 334 formed by a wall 333.

Each coupling feature 332 complements a coupling feature 322 of the cover 320. Specifically, coupling feature 332-1 extends from the right side wall 367 adjacent to the top wall 336, and coupling feature 332-1 extends from the left side wall 331 adjacent to the bottom wall 368. Coupling feature 332-1 includes wall 333-1 that forms aperture 334-1 for receiving coupling feature 322-1 of the cover 320. Coupling feature 332-2 includes wall 333-2 that forms aperture 334-2 for receiving coupling feature 322-2 of the cover 320. The aperture 334 of each coupling feature 332 can be wide enough to allow the complementary coupling feature 321 of the cover 320 to move within the aperture 334, thereby allowing a coupling feature 321 of the cover 320 to become decoupled from a corresponding coupling feature 331 of the body 330.

In certain example embodiments, the back wall 337 can have a number of openings 339 to allow one or more components disposed within the enclosure 340 to have direct contact with the inner wall 192 of the water heater 190. Further, there can be one or more of a number of coupling features 338 (in this case, tabs) disposed on one or more walls (in this case, the back wall 337), where such coupling features 338 couple to one or more components disposed within the enclosure 340. In some cases, the body 330 can include an extension 335 that complements the extension 325 of the cover 320. In this case, the extension 335 is located at the bottom end of the body 330.

In this case, back wall 337-1 (shown in FIG. 5B) is used to support part of temperature coupling feature 358-1, part of which extends through the opening 339 formed by the back wall 337-1, as shown in FIG. 3D. When temperature coupling feature 358-1 is designed to be surface-mounted against the inner wall (e.g., inner wall 192) forming the tank (e.g., tank 195) of the water heater (e.g., water heater 190), this configuration (e.g., coupling features 321) of the enclosure 340 allows the temperature coupling feature 358-1 to abut against the inner wall, thereby allowing the temperature coupling feature 358-1 to operate properly.

Similarly, back wall 337-2 (shown in FIG. 5B) is used to support part of the ECO 356, part of which extends through the opening 339 formed by the back wall 337-2, as shown in FIG. 3D. When the ECO 356 is designed to be surface-mounted against the inner wall (e.g., inner wall 192) forming the tank (e.g., tank 195) of the water heater (e.g., water heater 190), this configuration (e.g., coupling features 321) of the enclosure 340 allows the ECO 356 to abut against the inner wall, thereby allowing the ECO 356 to operate properly.

In certain example embodiments, the body 330 of the enclosure 340 can include one or more coupling features 388 that can be in communication with another coupling feature of the water tank. For example, in this case, there are two coupling features 388 disposed toward the bottom end of the body 330, where each coupling feature 388 is a tab with a declining ramp feature. These coupling features 388 can be used to help secure the enclosure 340 against the inner wall forming the tank of the water heater. An example of show these coupling features 388 of the body 330 can be used is shown in FIGS. 6A-6C below.

Figure 6B:
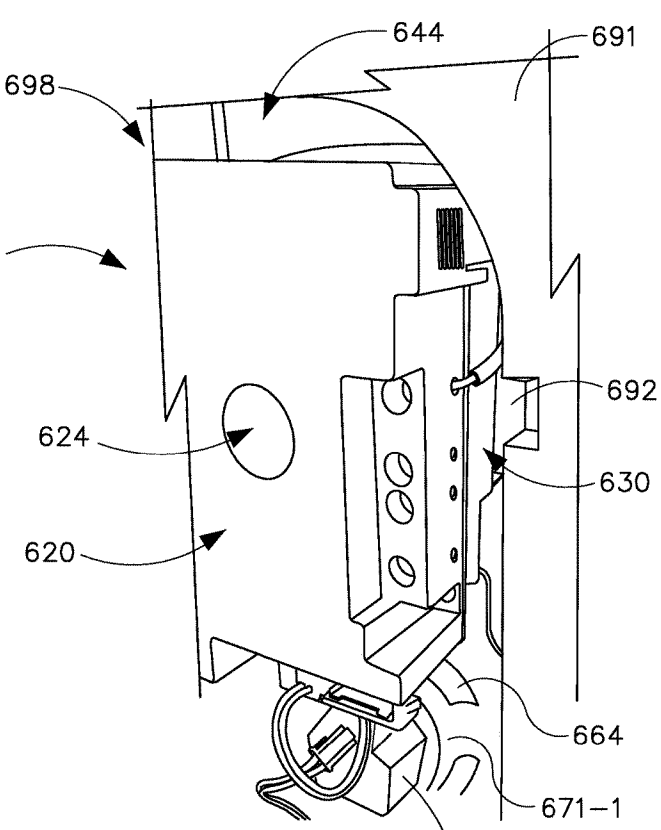
FIGS. 6A-6C show various views of a water heater with an enclosure in accordance with certain example embodiments.
Figure 6A:
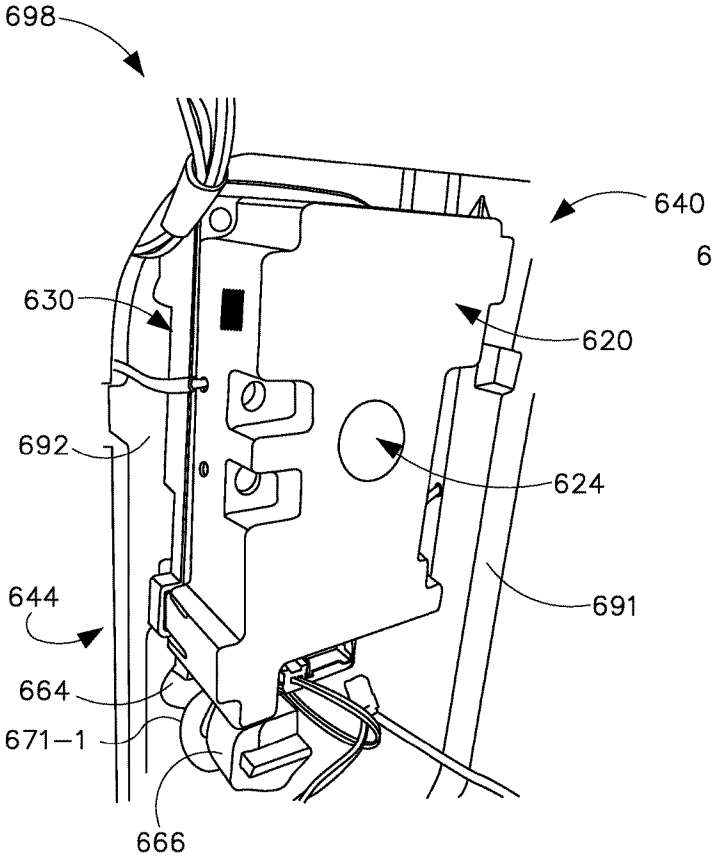
Figure 6C:
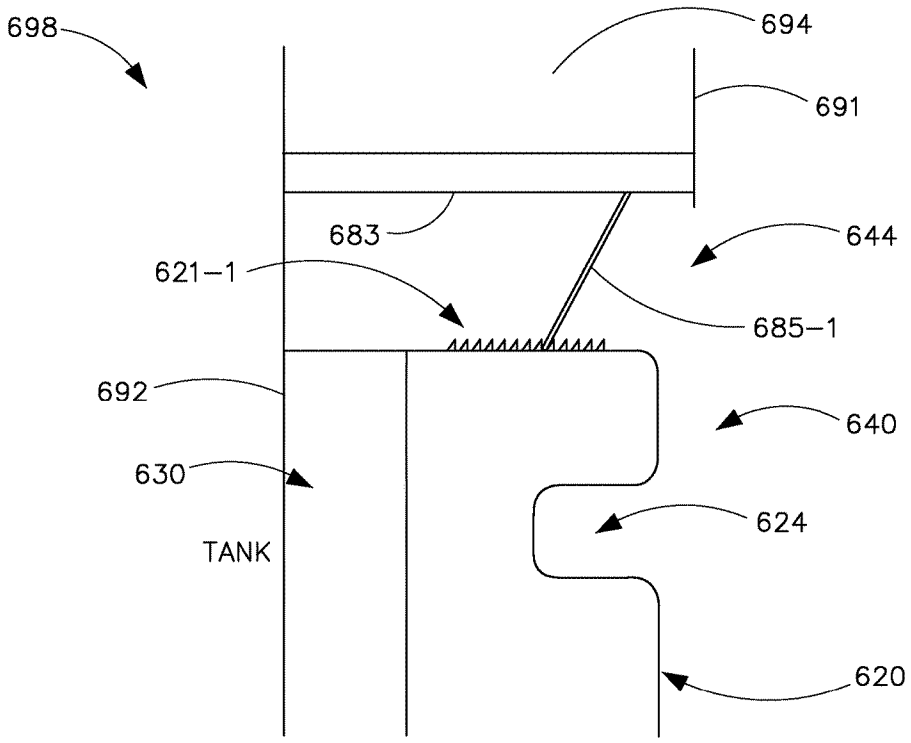

FIGS. 6A-6C show various views of a water heater portion 698 with an enclosure 640 in accordance with certain example embodiments. Specifically, FIG. 6A shows a left side perspective view of the water heater portion 698. FIG. 6B shows a right side perspective view of the water heater portion 698. FIG. 6C shows a partial cross-sectional side view of the water heater portion 698. Referring to FIGS. 1A-6C, the enclosure 640 can be substantially the same as the enclosure 340 discussed above. For example, the enclosure 640 of FIGS. 6A-6C includes a cover 620 and a body 630 that are coupled to each other. As another example, the cover 620 has an aperture 624 that traverses therethrough to allow access to a component (e.g., the ECO 156, a display) disposed within the enclosure 640 without removing or otherwise decoupling the cover 620 from the body 630 of the enclosure 640.

As shown in FIGS. 6A-6C, the enclosure 640 is disposed within an aperture 644 in the outer wall 691 of the water heater. The insulation 694 is also removed from the aperture 644, leaving the inner wall 692 of the water heater exposed. This allows the enclosure 640 to abut against the inner wall 692 of the water heater. This allows one or more components (e.g., the ECO 356, the temperature sensor 358-1) to be positioned against the inner wall 692 forming the tank so that those components operate properly. The enclosure is held in place within the aperture 644 against the inner wall 692 of the water heater using coupling features 621 disposed on the cover 620 and complementary coupling features 685 (not shown in FIGS. 6A and 6B, but shown in FIG. 6C) of the water heater.

The coupling features 685 of the water heater in this case are tabs that extend toward the enclosure 640 at an acute angle relative to the outer wall 691 of the water heater. When the enclosure 640 is positioned against the inner wall 692 of the water heater within the cavity 644, a coupling feature 685 becomes wedged between adjacent ridges in a complementary coupling feature 621 disposed on the cover 620. For example, as shown in FIG. 6C, coupling feature 685-1 of the water heater is wedged between adjacent ridges in coupling feature 621-1 of the cover 620.

The coupling feature 685-1 can be positioned within the cavity 644 in one or more of a number of ways. For example, as shown in FIG. 6C, the coupling feature 685-1 can extend from a plate 683 that extends from and between the outer wall 691 and the inner wall 692 of the water heater. As another example, there is no plate 683, and instead the coupling feature 685-1 is directly coupled to and extends from the outer wall 691 of the water heater.

The coupling features 685 of the water heater and the corresponding coupling features 621 of the cover 620 of the enclosure 640 can be the sole means of holding the enclosure 640 against the inner wall 692 of the water heater. Alternatively, the coupling features 685 of the water heater and the corresponding coupling features 621 of the cover 620 of the enclosure 640 can be used in conjunction with one or more other means (e.g., clips, fasteners, brackets, bands) of holding the enclosure 640 against the inner wall 692 of the water heater.

As discussed above, in addition to the coupling features 621 disposed on the enclosure 640, the enclosure 640 can be secured against the inner wall 692 of the water heater using one or more other coupling features (e.g., coupling features 388 of the body 330 of the enclosure 340). For example, in this case, there is a heating element 671-1 disposed just below the enclosure 640. The heating element 671-1 is disposed in the inner wall 692 so that part of the heating element 671-1 is disposed outside the tank, while the rest of the heating element 671-1 is disposed inside the tank. A temperature controller 666 is disposed on the end of the heating element 671-1 outside the tank.

The heating element 671-1 is held in place, at least in part, by a coupling feature 664. In this case, the coupling feature 664 is a circular clip that is disposed around the outer perimeter of the heating element 671-1 adjacent to the inner wall 692 outside the tank. This coupling feature 664 can also be disposed atop (abut against) one or more coupling features (e.g., coupling features 388) of the body (e.g., body 330) of the enclosure 640. When this occurs, working in conjunction with the coupling features 621 disposed on the cover 620 of the enclosure 640, the one or more coupling features (e.g., coupling features 388) of the body (e.g., body 330) of the enclosure 640 can help secure the enclosure against the inner wall 692 of the tank.

Figure 8:
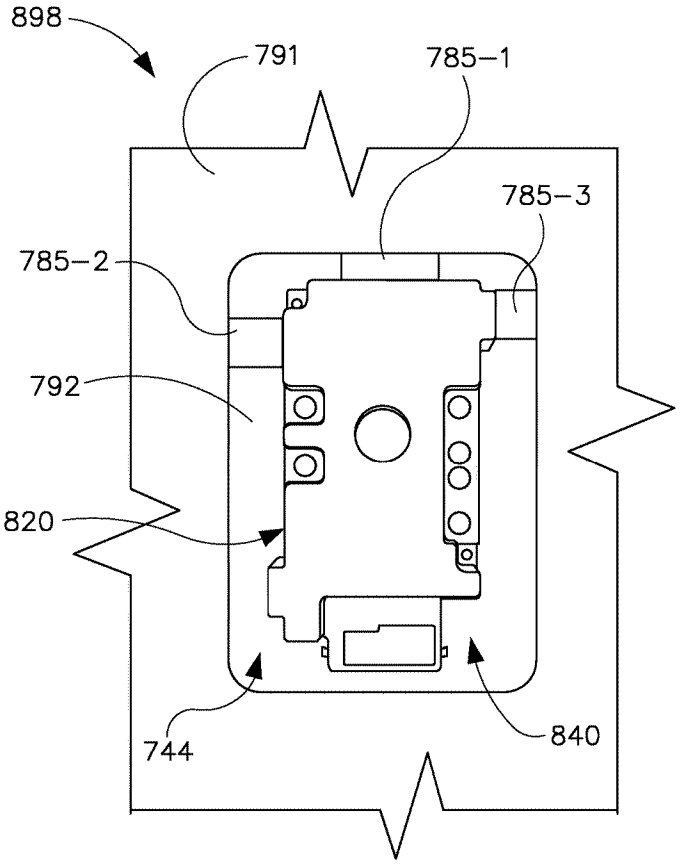
FIG. 8 shows the water heater of FIG. 7 with an enclosure in accordance with certain example embodiments.
Figure 7:
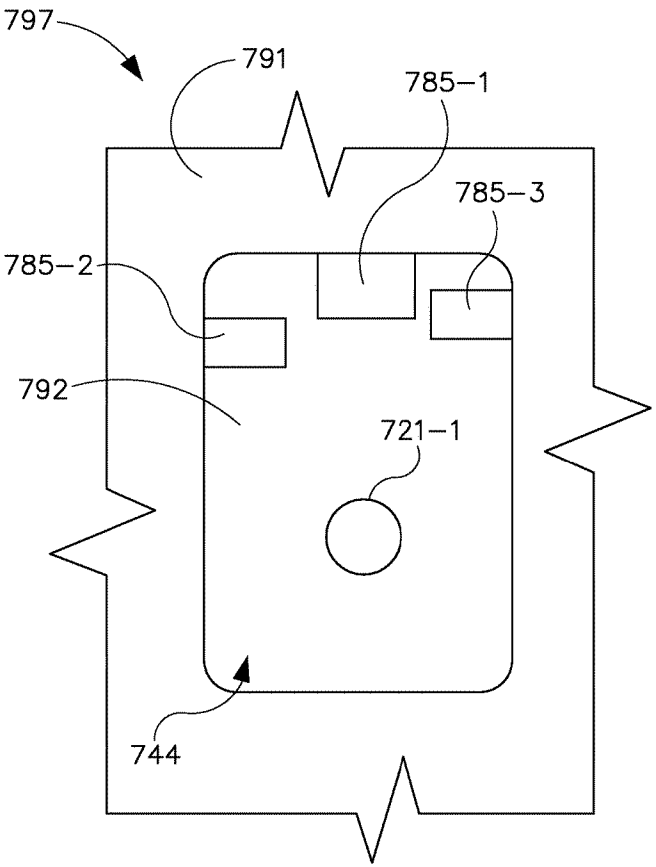
FIG. 7 shows a water heater without an enclosure in accordance with certain example embodiments.

FIG. 7 shows a water heater portion 797 without an enclosure in accordance with certain example embodiments. FIG. 8 shows the water heater portion 898 of FIG. 7 with an enclosure 840 in accordance with certain example embodiments. The water heater portion 797 of FIG. 7 and the water heater portion 898 of FIG. 8 are substantially similar to the water heater portion 698 of FIG. 6. Referring to FIGS. 1A-8, the water heater portion 797 of FIG. 7 shows that there are three enclosure coupling features 785 that extend into the cavity 744. Specifically, coupling feature 785-1 extends into the cavity 744 from the top of the cavity 744. Coupling feature 785-2 extends into the cavity 744 from the left of the cavity 744. Coupling feature 785-3 extends into the cavity 744 from the right of the cavity 744.

The position of these coupling features 785 correspond to the location of the coupling features (hidden from view, corresponding to coupling features 621 of FIGS. 6A-6C) on the outer surface of the cover 620 as well as the position of the enclosure 840 within the cavity 744 formed in the outer wall 791 of the water heater. The coupling features 785 can be flexible, so that the enclosure 840 can be properly positioned within the cavity 744 and be forced against the inner wall 792 of the water heater with sufficient force.

Figure 9:
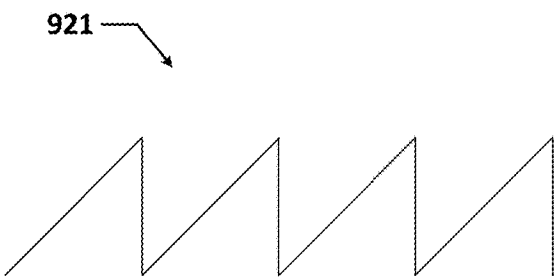
FIGS. 9-12 show various ridge configurations of water heater coupling features in accordance with certain example embodiments.
Figure 10:
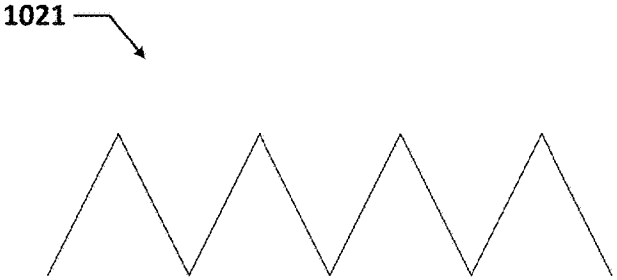
Figure 11:
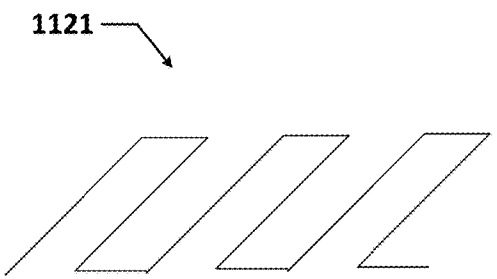
Figure 12:
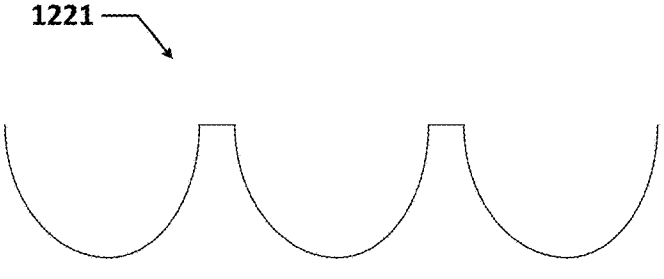

The water heater coupling features disposed on the cover 820 of the enclosure 840 can have any of a number of different ridge configurations. For example, FIGS. 9-12 show various ridge configurations of water heater coupling features in accordance with certain example embodiments. Referring to FIGS. 1A-12, the ridge configuration of the water heater coupling feature 921 of FIG. 9 are half sawteeth. The ridge configuration of the water heater coupling feature 1021 of FIG. 10 are full sawteeth. The ridge configuration of the water heater coupling feature 1121 of FIG. 11 are angled parallel slots. The ridge configuration of the water heater coupling feature 1221 of FIG. 12 are concave arches.

Example embodiments can used to hold an enclosure against a water heater tank at a certain position and with a certain amount of force. Such an example enclosure can house one or more of a number of components, including but not limited to a controller, an ECO, a power module, a temperature sensor, and a heating element. Example embodiments can permanently or temporarily hold the enclosure in place against the tank of a water heater.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An enclosure for a water heater, the enclosure comprising:

a cover comprising an outer surface, at least one body coupling feature, and at least one water heater coupling feature, wherein the at least one water heater coupling feature comprises a first plurality of ridges placed in parallel with each other, wherein the first plurality of ridges are disposed on the outer surface of the cover; and a body detachably coupled to the cover, wherein the body comprises at least one cover coupling feature that couples to the at least one body coupling feature of the cover, wherein the first plurality of ridges of the at least one water heater coupling feature is configured to receive an enclosure coupling feature of the water heater, wherein the enclosure coupling feature comprises a tab that extends from the water heater, wherein the tab, when received by two adjacent ridges of the first plurality of ridges, secures the body against a tank of the water heater.

2. The enclosure of claim 1, wherein the at least one water heater coupling feature is disposed along a top surface of the cover.

3. The enclosure of claim 2, wherein the at least one water heater coupling feature is further disposed along a first side surface of the cover.

4. The enclosure of claim 3, wherein the at least one water heater coupling feature is further disposed along a second side surface of the cover.

5. The enclosure of claim 1, wherein the at least one water heater coupling feature further comprises a second plurality of ridges placed in parallel with each other and disposed along a first side surface of the cover.

6. The enclosure of claim 5, wherein the first plurality of ridges are sawtooth protrusions that extend from the outer surface of the cover.

7. The enclosure of claim 5, wherein the first plurality of ridges are sawtooth recesses in the outer surface of the cover.

8. The enclosure of claim 5, wherein the first plurality of ridges are angled slots.

9. A water heater, comprising:

a tank defined by an inner wall;

an outer wall disposed around the tank, wherein the outer wall has a first aperture that traverses therethrough;

insulation disposed between the outer wall and the tank, wherein the insulation has a second aperture that traverses therethrough, wherein the second aperture is aligned with the first aperture, wherein the first aperture and the second aperture form a cavity that exposes a portion of the tank;

at least one enclosure coupling feature coupled to the outer wall adjacent to the first aperture, wherein the at least one enclosure coupling feature comprises a first tab; and an enclosure disposed within the cavity, wherein the enclosure comprises at least one wall having an outer surface, wherein the at least one wall comprises at least one water heater coupling feature that couples to the at least one enclosure coupling feature, wherein the at least one water heater coupling feature comprises a first plurality of ridges placed in parallel with each other, wherein the first plurality of ridges are disposed on the outer surface of the enclosure, wherein the enclosure is secured against the tank when the first tab of the at least one enclosure coupling feature is received by two adjacent ridges of the first plurality of ridges of the at least one water heater coupling feature.

10. The water heater of claim 9, wherein the enclosure houses a controller, an emergency cutoff switch, a power module, a temperature sensor, and a control device for a heating element.

11. The water heater of claim 10, wherein the enclosure allows access to the emergency cutoff switch by a user while the enclosure is secured against the tank.

12. The water heater of claim 9, wherein the first tab is disposed between the inner wall and the outer wall of the tank.

13. The water heater of claim 12, wherein the first tab is capable of being decoupled from the at least one water heater coupling feature by hand, thereby allowing removal of the enclosure from the cavity without use of tools.

14. The water heater of claim 12, wherein the tab extends toward the inner wall of the tank at an acute angle relative to the outer wall disposed around the tank.

15. The water heater of claim 12, wherein the first plurality of ridges are disposed on a top surface of the enclosure.

16. The water heater of claim 15, wherein the at least one enclosure coupling feature further comprises a second tab, wherein the at least one water heater coupling feature further comprises a second plurality of ridges, wherein the second plurality of ridges are disposed on a first side surface of the enclosure, wherein the second tab is disposed between two adjacent ridges of the second plurality of ridges when the at least one enclosure coupling feature is coupled to the at least one water heater coupling feature.

17. The water heater of claim 16, wherein the at least one enclosure coupling feature further comprises a third tab, wherein the at least one water heater coupling feature further comprises a third plurality of ridges, wherein the third plurality of ridges are disposed on a second side surface of the enclosure, wherein the third tab is disposed between two adjacent ridges of the third plurality of ridges when the at least one enclosure coupling feature is coupled to the at least one water heater coupling feature.

18. The water heater of claim 9, wherein the enclosure comprises a cover and a body coupled to the enclosure, wherein the at least one water heater coupling feature is disposed on the cover.

19. The water heater of claim 9, wherein the at least one enclosure coupling feature is directly coupled to the outer wall.

20. The water heater of claim 9, wherein the at least one enclosure coupling feature is coupled to a plate, wherein the plate is disposed between the inner wall and the outer wall.

* * * * *